US007921772B2

(12) United States Patent
Shih

(10) Patent No.: US 7,921,772 B2
(45) Date of Patent: Apr. 12, 2011

(54) COVER FOR AN AUTOMATICALLY RE-INKED STAMP

(75) Inventor: Shiny Shih, Yungkang (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 515 days.

(21) Appl. No.: 12/073,915

(22) Filed: Mar. 12, 2008

(65) Prior Publication Data

US 2009/0229482 A1 Sep. 17, 2009

(51) Int. Cl.
*B41K 1/42* (2006.01)

(52) U.S. Cl. ..... 101/334; 101/333

(58) Field of Classification Search ..... 101/103, 101/104, 105, 327, 333, 334, 405, 406
See application file for complete search history.

(56) References Cited

U.S. PATENT DOCUMENTS

| | | | | |
|---|---|---|---|---|
| 4,570,810 | A * | 2/1986 | Hawkins | 215/253 |
| 6,058,840 | A * | 5/2000 | Poplawski et al. | 101/405 |
| 6,302,022 | B1 * | 10/2001 | Shih | 101/379 |
| 6,892,638 | B2 * | 5/2005 | Sculler | 101/333 |
| 7,021,211 | B1 * | 4/2006 | Shih | 101/405 |
| 7,066,089 | B1 * | 6/2006 | Shih | 101/334 |

* cited by examiner

*Primary Examiner* — Ren Yan
(74) *Attorney, Agent, or Firm* — Bacon & Thomas, PLLC

(57) ABSTRACT

A cover for an automatically re-inked stamp is design to be mounted detachably on an automatic re-inked stamp and provides a function of preventing the automatic re-inked stamp from inadvertent stamping. The cover has a base having an inner surface and a surrounding edge and two mounting tabs being oppositely mounted on and protruding perpendicularly from the inner surface of the base along the surrounding edge. Each mounting tab has a pulling recess being formed in an inward surface of the mounting tab adjacent to an inner end edge. The pulling recesses make the cover easier to be detached from the automatic re-inked stamp. That makes the automatically re-inked stamp more convenient to use.

3 Claims, 6 Drawing Sheets

COVER FOR AN AUTOMATICALLY RE-INKED STAMP

BACKGROUND OF THE INVENTION

1. Field of the Invention

The present invention relates to a cover for an automatically re-inked stamp, and particularly relates to a cover, which prevents the automatically re-inked stamp from losing ink and inadvertently stamping.

2. Description of Related Art

A conventional automatically re-inked stamp is a very convenient design for people to carry and use, which re-inks automatically after using every time so allows a user to stamp without an ink pad.

The conventional automatically re-inked stamp has a stamp base and a cover. The stamp base has a bottom, an opening and a stamping device. The opening is formed in the bottom of the stamp base. The stamping device is mounted in the opening and has a character plate. The cover is mounted on the stamp base, is movable relative to the stamp base and controls the character plate of the stamping device to rotate and stamp. However, when the conventional automatically re-inked stamp is put on a desk, it may be pressed by accident and stamp the desk or documents on the desk. That is annoying and inconvenient for using.

Therefore, a protecting device was designed to solve the problem. For example, U.S. Pat. No. 7,066,089 discloses another conventional automatically re-inked stamp that can effectively prevent inadvertent stamping and has a protecting device. The protecting device has multiple positioning assemblies. Each positioning assembly has a hook to hold the conventional automatically re-inked stamp in position relatively on the protecting device.

Even though the protecting device efficiently prevents inadvertent stamping, but applying the hooks as a positioning means would make the conventional automatically re-inked stamp hard to be detached from the protecting device. That is very inconvenient while using the conventional automatically re-inked stamp.

To overcome the shortcomings, the present invention provides a cover for an automatically re-inked stamp to mitigate or obviate the aforementioned problems.

SUMMARY OF THE INVENTION

The main objective of the present invention is to provide a cover for an automatically re-inked stamp, which protects the automatically re-inked stamp and is easy to be detached from the automatically re-inked stamp.

The cover for an automatically re-inked stamp is design to be mounted detachably on the automatic re-inked stamp and provides a function of preventing the automatic re-inked stamp from inadvertent stamping. Moreover, structures are designed to make the cover easier to be detached from the automatic re-inked stamp. That makes the automatically re-inked stamp more convenient to use.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
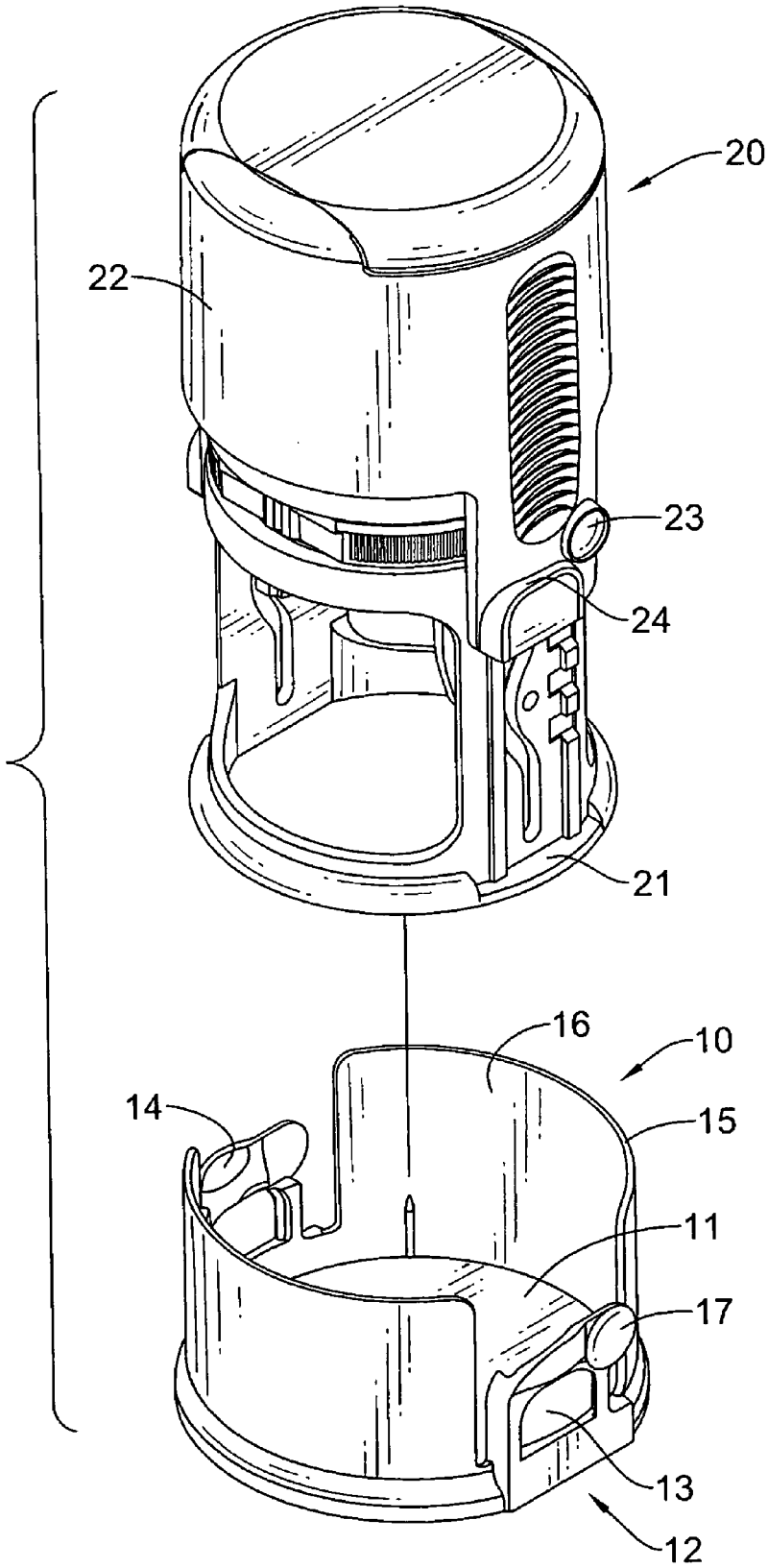
FIG. 1 is an exploded perspective view of an automatically re-inked stamp and a cover for the automatically re-inked stamp in accordance with the present invention.
Figure 2:
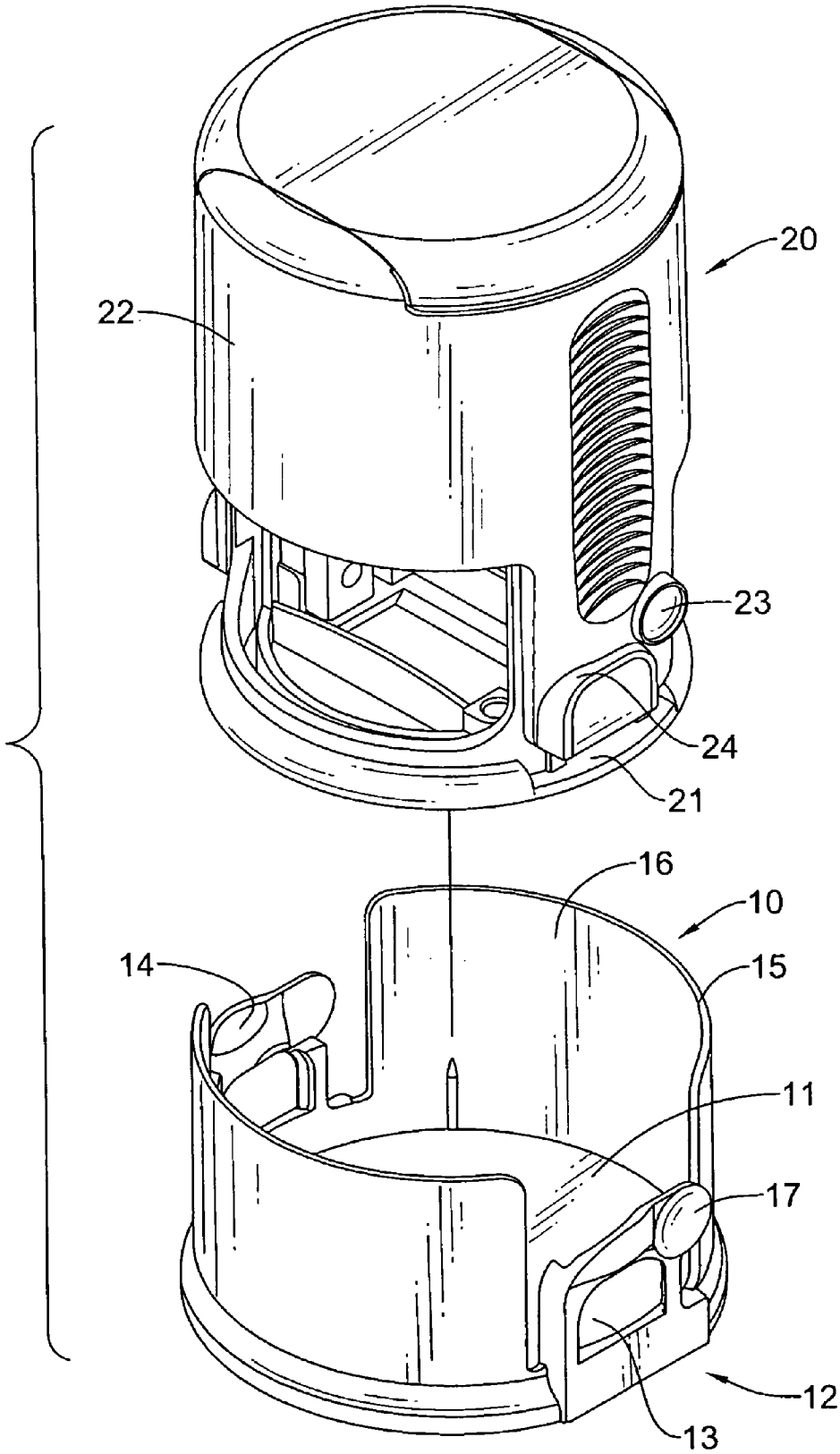
FIG. 2 is an operational exploded perspective view of the automatically re-inked stamp and the cover for the automatically re-inked stamp in FIG. 1.
Figure 3:
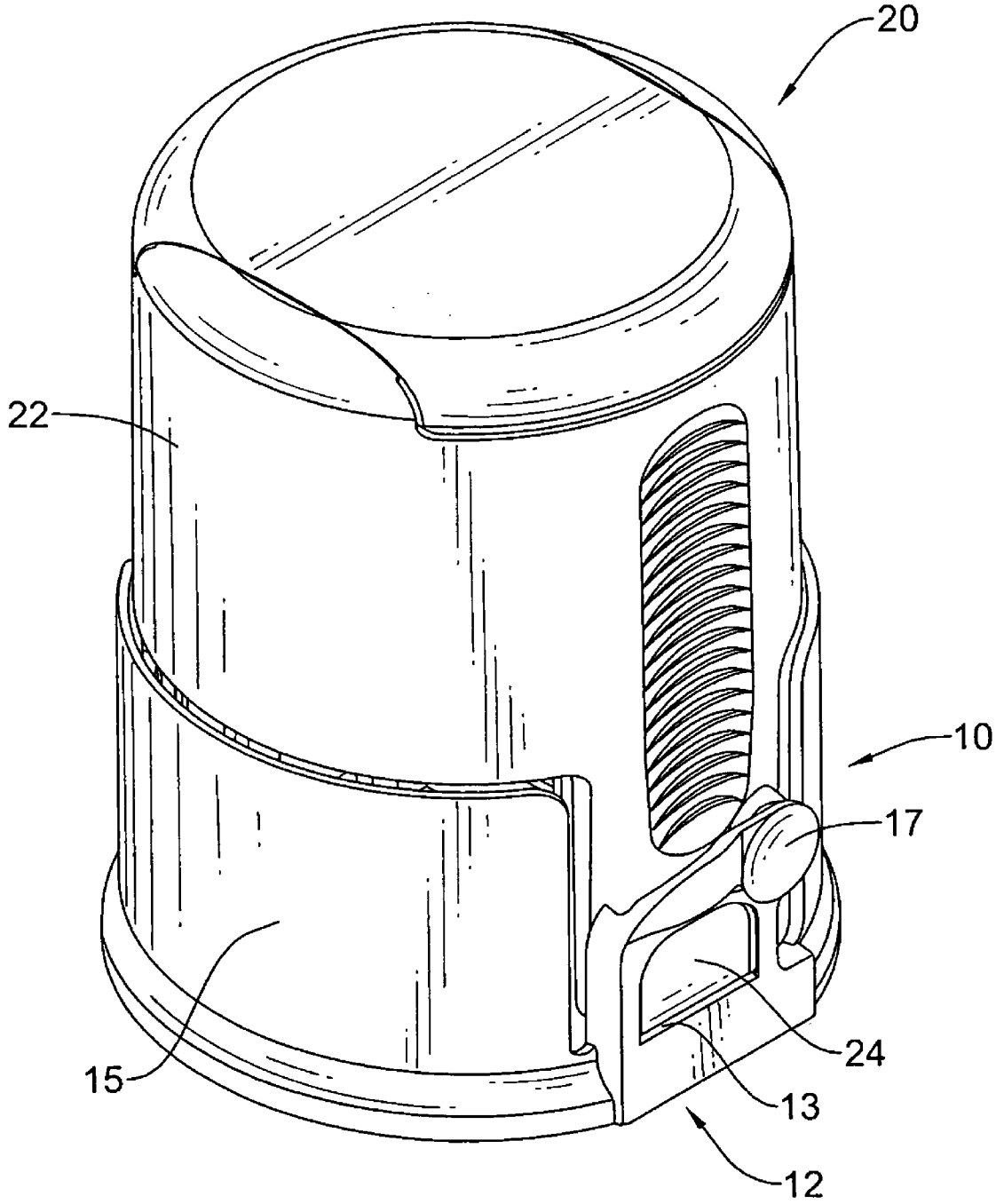
FIG. 3 is an operational perspective view of the automatically re-inked stamp and the cover for the automatically re-inked stamp in FIG. 1.

With reference to FIGS. 1 to 3, an automatically re-inked stamp (20) has a stamp base (21) and a casing (22).

The stamp base (21) is hollow and has a character unit. The character unit is mounted movably in the stamp base (21).

The casing (22) is mounted slidably on the stamp base (21) and has an outside wall, a bottom, a control button (23) and two mounting portions (24). The control button (23) is formed on the outside wall of the casing (22) to control the stamp base (21) to move upwards and downwards relative to the casing (22). The mounting portions (24) are formed oppositely on and protrudes transversely from the outside wall of the casing (22) near the bottom.

A cover (10) for an automatically re-inked stamp (20) in accordance with the invention corresponds to and is detachably mounted on the bottom of the casing (22) of the automatically re-inked stamp (20) and has a base (11), two mounting tabs (12) and two positioning walls (15).

Figure 5:
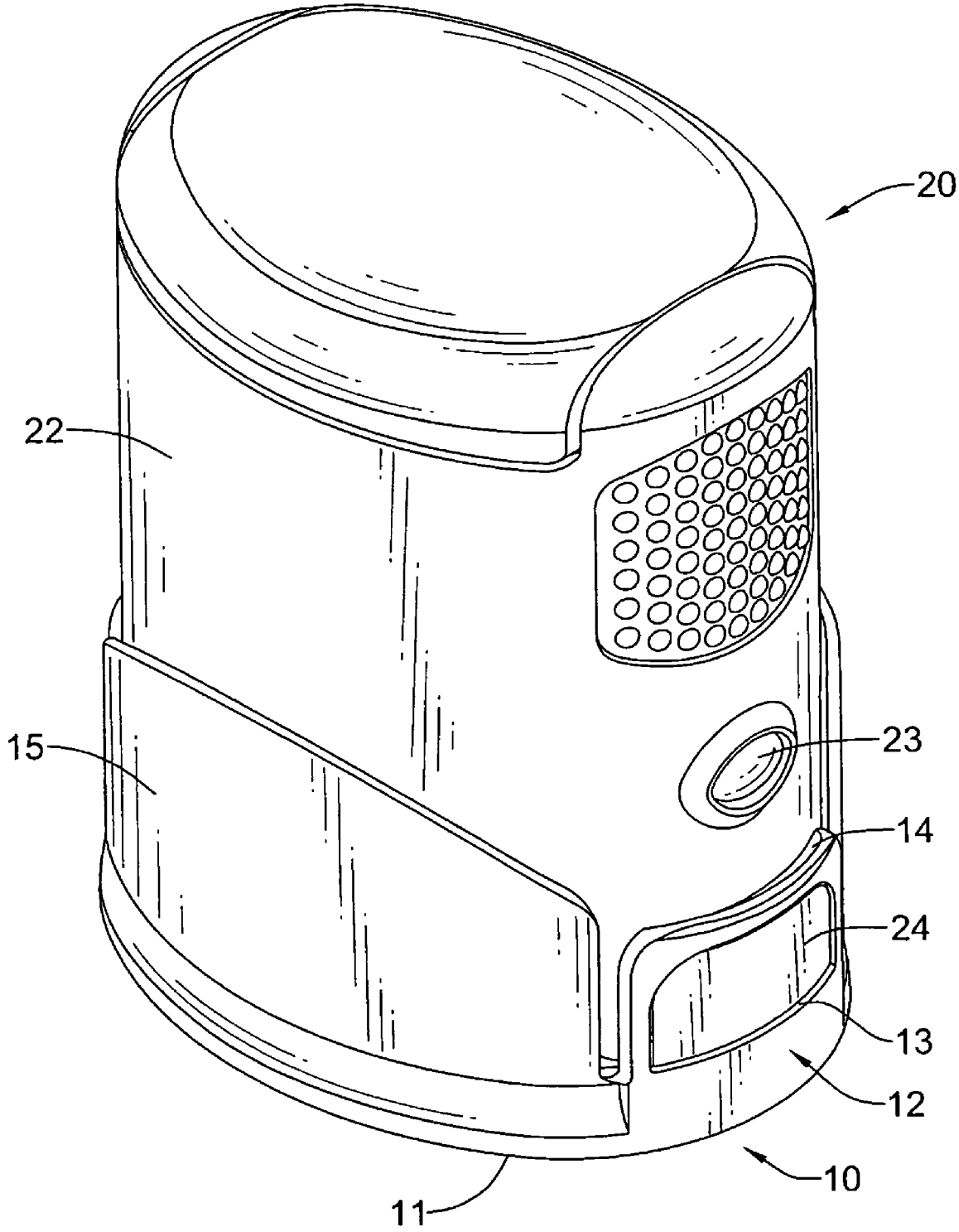
FIG. 5 is an operational perspective view of a second embodiment of the automatically re-inked stamp and the cover for the automatically re-inked stamp.
Figure 6:
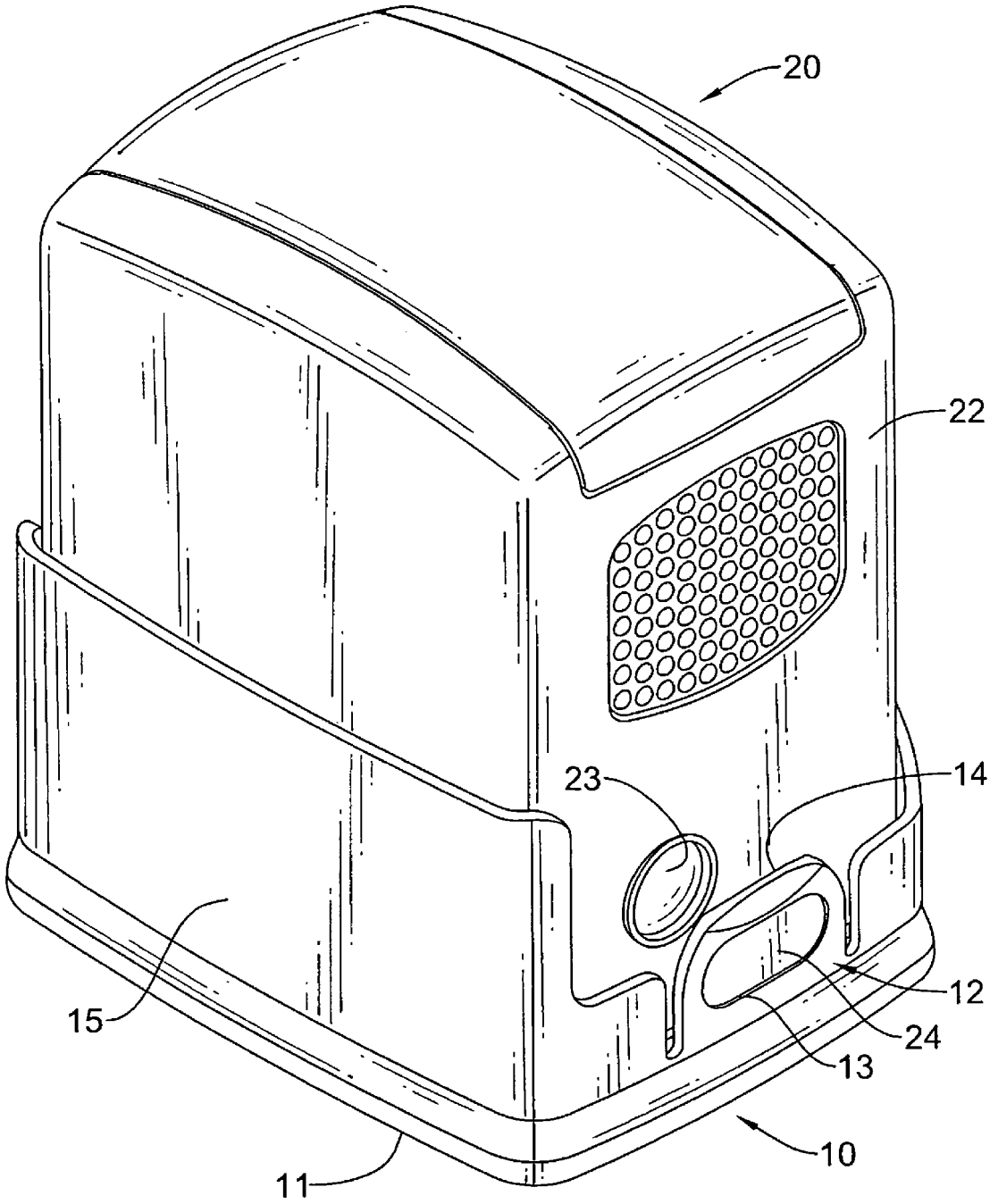
FIG. 6 is an operational perspective view of a third embodiment of the automatically re-inked stamp and the cover for the automatically re-inked stamp.

With further reference to FIGS. 5 and 6, the base (11) corresponds to a shape of the automatically re-inked stamp (20), may be round, may be oval-shaped, may be rectangular and has an inner surface and a surrounding edge.

The mounting tabs (12) are oppositely mounted on and protrudes perpendicularly from the inner surface of the base (11) along the surrounding edge, correspond to the mounting portions (24). Each mounting tab (12) has an inner end edge, an inward surface, a mounting hole (13), a pulling recess (14) and a protecting head (17).

Figure 4:
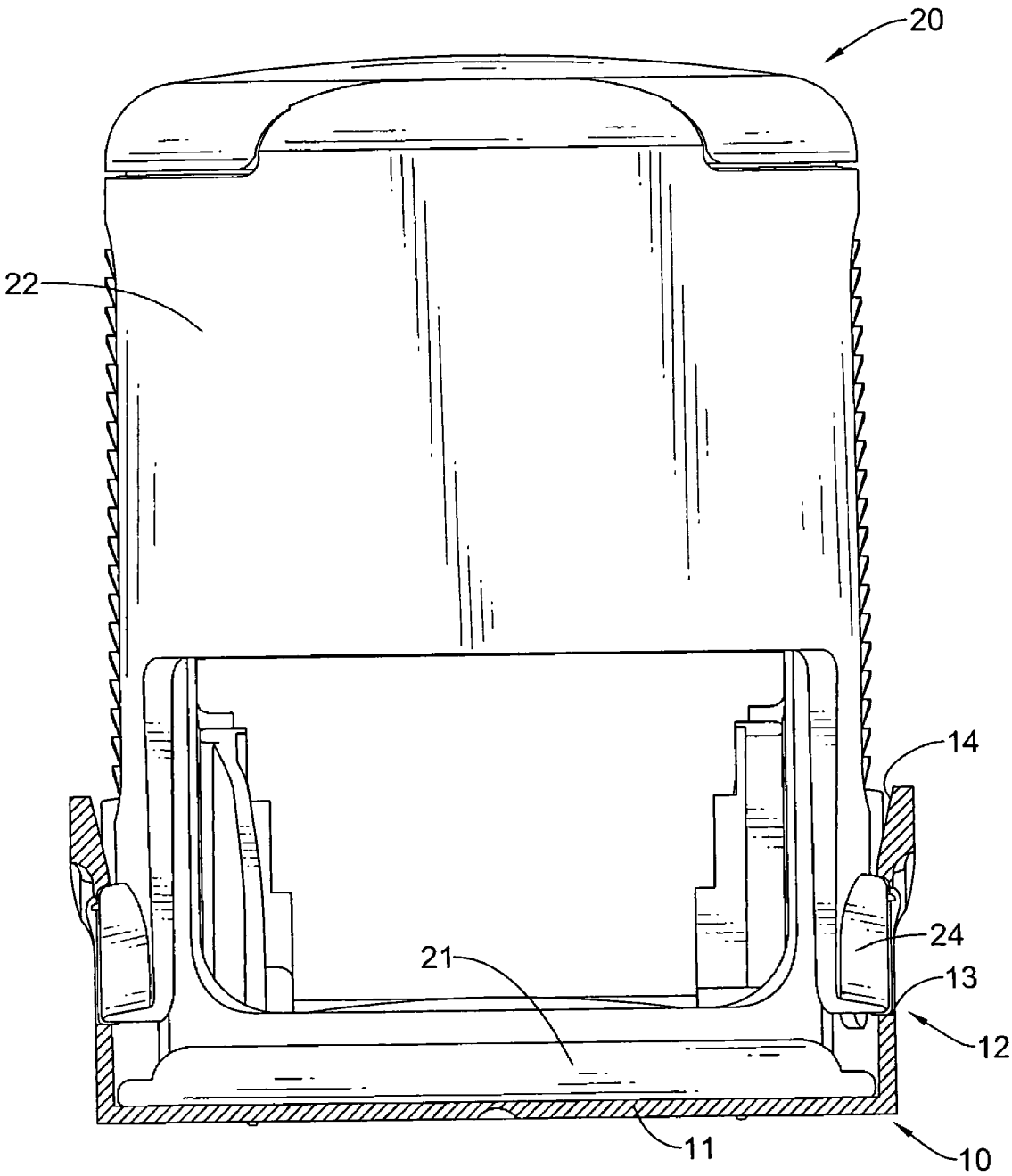
FIG. 4 is an operational side view in partial section of the automatically re-inked stamp and the cover for the automatically re-inked stamp in FIG. 1.

With further reference to FIG. 4, the mounting hole (13) is formed through the mounting tab (12) and corresponds to and is selectively mounted around the mounting portion (24) such that engages the cover (10) on the casing (22).

The pulling recess (14) is formed in the inward surface of the mounting tab (12) adjacent to the inner end edge such that allows a user to insert his fingers in and bend the mounting tabs (12) outwardly to detach the cover (10).

The protecting head (17) may be a round shell, is formed on the mounting tab (12) and corresponds to one of the control button (23) when the cover (10) is mounted on the automatically re-inked stamp (20) to prevent the control buttons (23) to be touched accidentally.

The positioning walls (15) are elongated, are oppositely formed on and protrude perpendicularly from the inner surface of the base (11) along the surrounding edge to form a cavity (16). Each positioning wall (15) is formed between the two mounting tabs (12) such that the positioning walls (15) oppose one another. Together, the positioning walls (15) and the mounting tabs (12) surround the inner surface of the base (11). The cavity (16) fits an outside surface of the automatically re-inked stamp (20) to hold the automatically re-inked stamp (20) in position.

Consequently, the cover (10) for an automatically re-inked stamp (20) as described effectively prevents the automatically re-inked stamp (20) from inadvertent stamping, so avoids contaminating the desk or documents.

Moreover, having the design of the pulling recess (14) makes the cover (10) much easier to be detached from the automatically re-inked stamp (20). That makes the automatically re-inked stamp (20) more convenient to use.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A cover for an automatically re-inked stamp comprising:

a base having an inner surface and a surrounding edge;

two mounting tabs being oppositely mounted on and protruding perpendicularly from the inner surface of the base along the surrounding edge, and each mounting tab having an inner end edge;

an inward surface;

a mounting hole being formed through the mounting tab; and a pulling recess being formed in the inward surface of the mounting tab adjacent to the inner end edge; and two positioning walls being oppositely formed on and protruding perpendicularly from the inner surface of the base along the surrounding edge, and each positioning wall being formed between the mounting tabs such that the positioning walls and the mounting tabs together surround the inner surface of the base.

2. The cover for an automatically re-inked stamp as claimed in claim 1 further comprising two protecting heads.

3. The cover for an automatically re-inked stamp as claimed in claim 2, wherein each protecting head is formed on a corresponding mounting tab.

* * * * *